US007459057B2

(12) United States Patent
Zuniga et al.

(10) Patent No.: US 7,459,057 B2
(45) Date of Patent: Dec. 2, 2008

(54) SUBSTRATE RETAINER

(75) Inventors: Steven M. Zuniga, Soquel, CA (US); Hung Chih Chen, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1174 days.

(21) Appl. No.: 10/199,738

(22) Filed: Jul. 18, 2002

(65) Prior Publication Data

US 2002/0179251 A1 Dec. 5, 2002

Related U.S. Application Data

(63) Continuation of application No. 09/080,094, filed on May 15, 1998, now Pat. No. 6,436,228.

(51) Int. Cl.
*C23F 1/02* (2006.01)
*B28B 1/00* (2006.01)
*B32B 13/00* (2006.01)

(52) U.S. Cl. ..... 156/345.14

(58) Field of Classification Search ..... 156/345.12, 156/345.14; 451/388, 398, 365, 289, 287, 451/380, 405, 41, 285, 387
See application file for complete search history.

(56) References Cited

U.S. PATENT DOCUMENTS

| | | | | |
|---|---|---|---|---|
| 4,319,432 | A | 3/1982 | Day | |
| 4,954,142 | A | 9/1990 | Carr et al. | |
| 5,205,082 | A * | 4/1993 | Shendon et al. | 451/41 |
| 5,398,459 | A | 3/1995 | Okumura et al. | |
| 5,533,924 | A | 7/1996 | Stroupe et al. | |
| 5,584,746 | A | 12/1996 | Tanaka et al. | |
| 5,584,751 | A | 12/1996 | Kobayashi et al. | |
| 5,624,299 | A | 4/1997 | Shendon | |
| 5,635,083 | A | 6/1997 | Breivogel et al. | |
| 5,643,061 | A * | 7/1997 | Jackson et al. | 451/289 |
| 5,944,593 | A | 8/1999 | Chiu et al. | |
| 6,080,040 | A * | 6/2000 | Appel et al. | 451/10 |
| 6,110,025 | A * | 8/2000 | Williams et al. | 451/286 |
| 6,146,256 | A | 11/2000 | Joo | |
| 6,251,215 | B1 * | 6/2001 | Zuniga et al. | 156/345.14 |
| 6,386,955 | B2 * | 5/2002 | Zuniga et al. | 451/56 |
| 6,390,904 | B1 | 5/2002 | Gleason et al. | |
| 6,436,228 | B1 * | 8/2002 | Zuniga et al. | 451/285 |
| 6,511,367 | B2 * | 1/2003 | Zuniga et al. | 451/285 |
| 6,602,116 | B1 * | 8/2003 | Prince | 451/51 |
| 6,712,672 | B1 * | 3/2004 | Joo | 451/41 |
| 6,722,965 | B2 * | 4/2004 | Zuniga et al. | 451/288 |
| 6,979,250 | B2 * | 12/2005 | Zuniga et al. | 451/41 |
| 7,001,245 | B2 * | 2/2006 | Chen | 451/8 |
| 2002/0179251 | A1 * | 12/2002 | Zuniga et al. | 156/346 |
| 2005/0211377 | A1 * | 9/2005 | Chen et al. | 156/345.12 |

FOREIGN PATENT DOCUMENTS

| | | |
|---|---|---|
| EP | 0 790 0100 | 8/1997 |

* cited by examiner

*Primary Examiner*—Sylvia R. MacArthur
(74) *Attorney, Agent, or Firm*—Fish & Richardson

(57) ABSTRACT

A retainer is used with an apparatus for polishing a substrate. The substrate has upper and lower surfaces and a lateral, substantially circular, perimeter. The apparatus has a polishing pad with an upper polishing surface for contacting and polishing the lower face of the substrate. The retainer has an inward facing retaining face for engaging and retaining the substrate against lateral movement during polishing of the substrate. The retaining face engages a substrate perimeter at more than substantially a single discrete circumferential location along the perimeter.

3 Claims, 8 Drawing Sheets

SUBSTRATE RETAINER

CROSS-REFERENCE TO RELATED APPLICATIONS

This application is a continuation (and claims the benefit of priority under 35 USC 120) of U.S. application Ser. No. 09/080,094, filed May 15, 1998, now U.S. Pat. No. 6,436,228.

BACKGROUND

The present invention relates generally to chemical mechanical polishing of substrates, and more particularly to a carrier head and substrate retainer of a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be a "standard" pad in which the polishing pad surface is a durable, roughened surface, or a fixed- abrasive pad in which abrasive particles are held in a containment media. The carrier head provides a controllable load, i.e., pressure, on the substrate to push it against the polishing pad. A polishing slurry, including at least one chemically-reactive agent, and abrasive particles if a standard pad is used, is supplied to the polishing pad.

The effectiveness of a CMP process may be measured by its polishing rate and by the resulting finish (e.g., absence of small-scale roughness) and flatness (e.g., absence of large-scale topography) of the substrate surface. The polishing rate, finish and flatness are determined by the pad and slurry combination, the relative speed between the substrate and pad, and the force pressing the substrate against the pad.

In the planarization of semiconductor substrate wafers by CMP, it is known to use an annular retaining ring encompassing a wafer being polished for the purpose of preventing lateral movement of the wafer resulting from friction between the wafer and a moving polishing pad. See, e.g., U.S. Pat. No. 5,205,082 of Norm Shendon, et al., the disclosure of which is incorporated herein by reference.

A reoccurring problem in CMP is the so-called "edge-effect", i.e., the tendency for the edge of the substrate to be polished at a different rate than the center of the substrate. The edge effect typically results in over-polishing (the removal of too much material from the substrate) of the perimeter portion of the substrate, e.g., the outermost five to ten millimeters, although the edge effect may also result in under-polishing. The over-polishing or under-polishing of the substrate perimeter reduces the overall flatness of the substrate, makes the edge of the substrate unsuitable for use in integrated circuits, and decreases the yield.

SUMMARY

In one aspect, the invention provides a retainer for use in conjunction with a substrate polishing apparatus. The apparatus may have a polishing pad with a polishing surface for contacting a face of the substrate. The retainer has an inward facing retaining face for engaging and retaining the substrate against lateral movement during polishing of the substrate. The retaining face engages the substrate perimeter at more than substantially a single discrete circumferential location along the perimeter.

Various embodiments of the invention may include one or more of the following. The retaining face may engage the substrate perimeter at a least two discrete, spaced-apart, locations. The retaining face may engage the substrate perimeter at exactly two discrete, spaced-apart, locations. The retaining face may engage the substrate perimeter along at least a continuous circumferential zone of engagement. The circumferential zone of engagement may span at least 10 degrees. The circumferential zone of engagement may span substantially the entire substrate perimeter. The retaining face may compressively engage the substrate perimeter at a plurality of circumferential locations along the perimeter.

The retaining face may be a continuous cylindrical inner surface of a continuous annular longitudinally-extending retainer portion. Such a retainer portion may have an opening for receiving the substrate at a lower end of the retainer portion and may have sufficient elasticity to accommodate the substrate while maintaining compressive engagement with the substrate. The retainer may be formed as an annular longitudinally-extending sleeve depending from a roof section of a retaining ring and separated from a body of the ring by an annular recess.

The retaining face may be a cylindrical inner surface of an annular longitudinally-extending sleeve portion. The retainer may further include an annular radially outwardly-extending flange, the sleeve portion depending from the flange, and the flange secured between a body of the retaining ring and a carrier body. Alternately, the retainer may include an annular radially-inwardly extending flange secured between a clamp and a membrane support structure.

The retaining face may be formed by an inner face of a band wrapped substantially entirely around the substrate and circumferentially adjustable to engage and release the substrate. The retainer may be elastomeric. The retainer may be formed as an annular lip depending from an substrate-backing membrane. The retainer may comprise a plurality of annular segments, each segment having a bottom face and a cylindrical inner face. The cylindrical inner faces of the segments may form a retaining face wherein the segments are selectively inwardly biasable so as to compressively engage the substrate perimeter. The retainer may comprise an inflatable annular bladder sandwiched between the segments and an inner face of a support structure so that inflation of the bladder biases the segments radially inward to engage the substrate perimeter.

By dispersing lateral contact forces between the retainer and substrate which otherwise would be concentrated at a single point of contact, the retainer may reduce localized distortions (e.g., vertical deflection of the substrate at the point of contact due to compression of the substrate by the retainer) in the substrate near its perimeter which might otherwise contribute to the "edge effect".

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
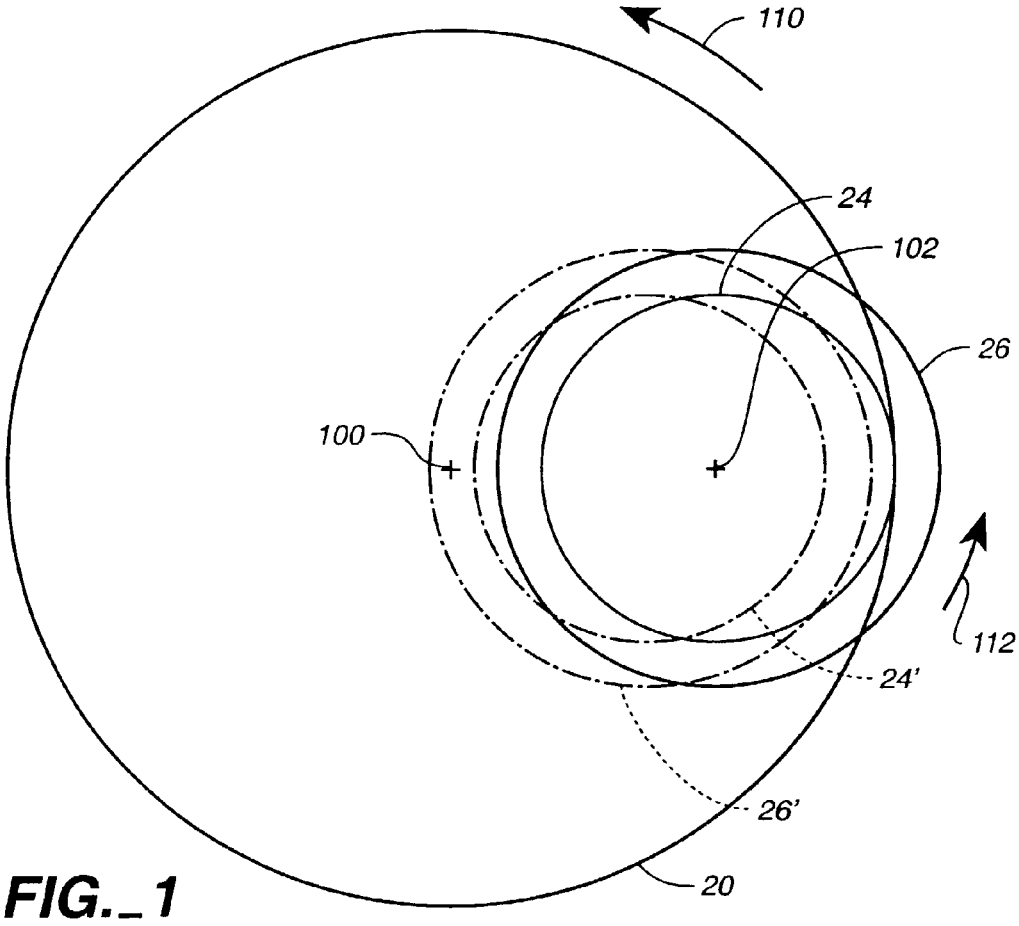
FIG. 1 is a schematic top view of a platen of a CMP system.
Figure 2:
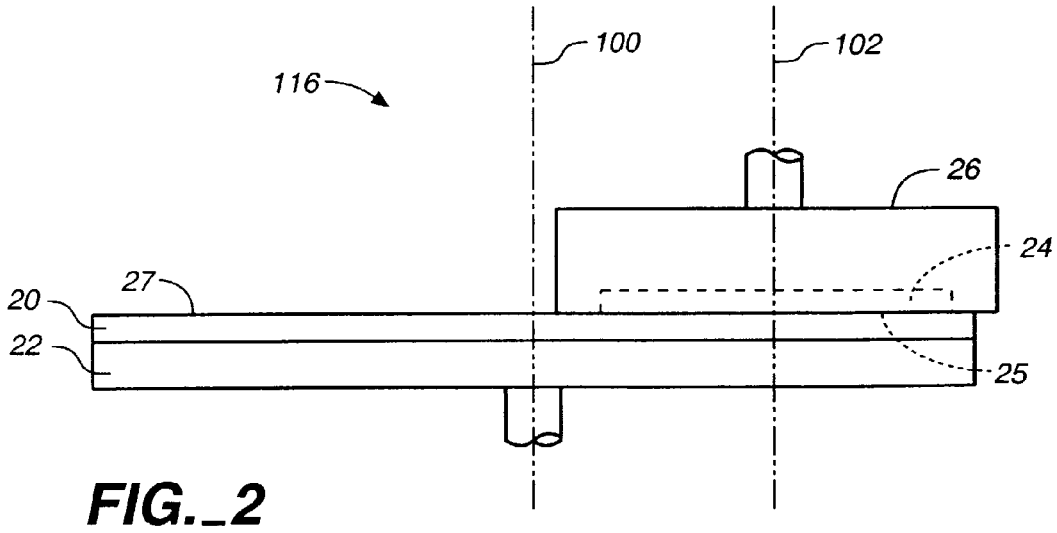
FIG. 2 is a schematic side view of the platen of FIG. 1.

FIGS. 1 and 2 show a polishing pad 20 secured atop a platen 22 (FIG. 2). The pad and platen rotate about a central axis 100. A substrate 24, e.g., a circular semiconductor wafer, is held by a substrate carrier or polishing head 26 which places a lower face 25 of the substrate against the upper (polishing) surface 27 of the pad. The carrier and substrate substantially rotate as a unit about the carrier's central axis 102. In addition to the rotation, the carrier and substrate may be simultaneously reciprocated between the solid line positions 24 and 26 and the broken line positions 24' and 26' shown in FIG. 1. In an exemplary embodiment, the pad 20 has a diameter of 20.0 inches, the substrate 24 has a diameter of 7.87 inches (for a 200 millimeter substrate, commonly referred to as an "8 inch" substrate), the carrier 26 has a external diameter of about 10 inches, and the carrier reciprocates so that the separation of its central axis 102 from the central axis 100 of the pad ranges between 4.2 and 5.8 inches. The rotational speed of the pad may be 60 to 150 rpm and that of the carrier may also be 60 to 150 rpm.

Figure 3:
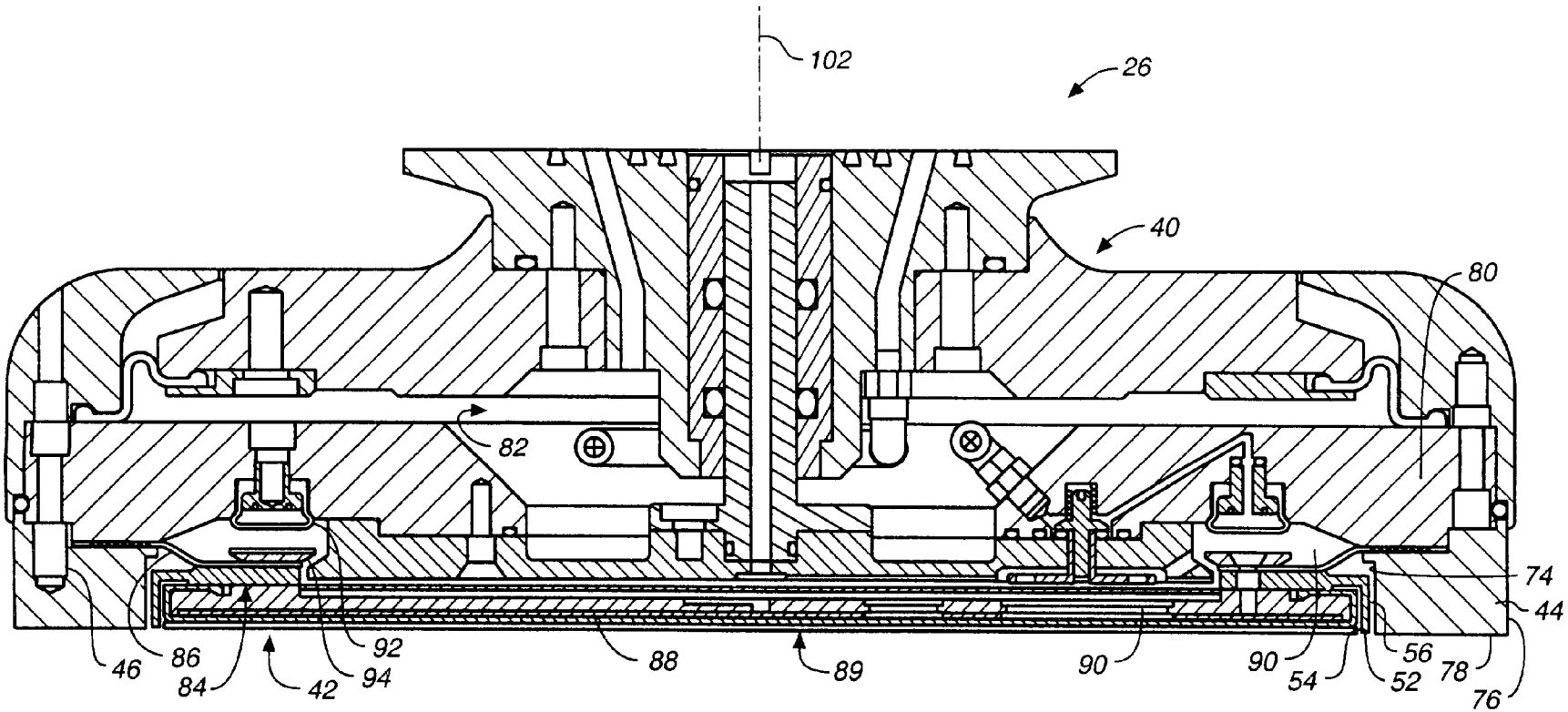
FIG. 3 is a cross-sectional view of a substrate carrier having a retainer according to the present invention.

FIG. 3 shows further details of one exemplary construction of the carrier head 26. The carrier head 26 includes a housing 40 and a generally cylindrical substrate backing assembly 42 for holding the substrate. The backing assembly can be moved up and down relative to the housing. The carrier further includes a generally annular retaining ring 44 for retaining the substrate within the carrier during polishing. The retaining ring 44 includes a cylindrical inner surface 74, a cylindrical outer surface 76, and an annular lower surface 78 connecting the inner surface 74 and the outer surface 76. The retaining ring may be attached to a base 80 of the carrier head 26 by means of screws or bolts in a plurality of mounting holes 46 (only one is shown in FIG. 3). The retaining ring 44 is movable vertically relative to the housing 40 independently of the backing assembly 42 so that desired independent downward forces may be applied to the retaining ring and substrate to maintain them in engagement with the polishing pad. A description of a similar carrier head may be found in U.S. patent application Ser. No. 08/745,670, by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is hereby incorporated by reference.

A loading chamber 82 is formed between the housing 40 and base 80. Pressurization of the loading chamber 82 applies a load, i.e., a downward pressure and force, to the base 80. The vertical position of the base 80 relative to the polishing pad (not shown) may be controlled via pressurization/depressurization of the loading chamber 82.

The substrate backing assembly 42 includes a support structure 84, a flexure 86 connected between the support structure and the base 80 and a flexible membrane 88 connected to and covering the underside of the support structure 84. The flexible membrane 88 extends below the support structure to provide a mounting surface for the substrate. The pressurization of a chamber 90 formed between the base 80 and the substrate backing assembly 42 presses the substrate against the polishing pad.

An annular bladder 92 is attached to the lower surface of the base 80. The bladder may be pressurized to engage an annular upper clamp 60 atop an inboard (e.g., relatively close to the central axis 102) portion of the flexure 86 so as to apply a downward pressure to the support structure 84 and thus the substrate. The chamber 82 and bladder 92 may each be pressurized and depressurized via introduction and removal of fluid delivered from one or more pumps (not shown) by associated conduits or piping (also not shown).

Thus, the vertical position of the base 80 and ring 44 relative to the housing 40 may be controlled by pressurization and depressurization of the loading chamber 82. The pressurization of the loading chamber 82 pushes the base downwardly, which pushes the lower surface 78 of the retaining ring downwardly to apply a load to the polishing pad.

The vertical position of the substrate backing assembly 42 and thus the substrate may be controlled by pressurization and depressurization of the chamber 90 and/or the bladder 92. Depressurization of the chamber 90 raises the membrane 88 so as to create suction between the membrane and substrate for lifting the substrate out of engagement with the polishing pad. Thus, the selective pressurization and depressurization of the loading chamber 82 on the one hand, and the bladder 92 and chamber 90 on the other hand provides for the independent maintenance of vertical position and engagement forces between the ring and pad and between the substrate and pad.

Figure 4:
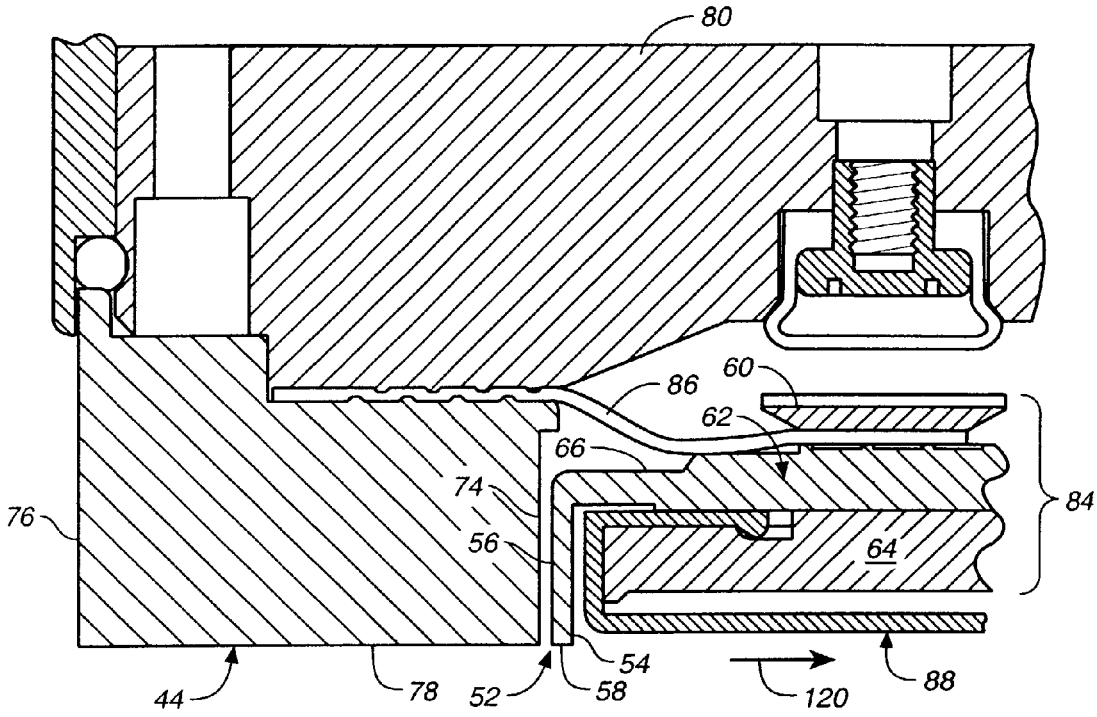
FIG. 4 is an enlarged view of the retainer of FIG. 3.

As shown in FIG. 4, the support structure 84 includes the upper clamp 60, a lower clamp 62, and a support ring or plate 64. An inner edge of the flexure 86 is clamped between the upper clamp 60 and the lower clamp 62, and the edge of the flexible membrane 88 is clamped between the lower clamp 62 and the support plate 64.

A retainer sleeve 52 extends downwardly from part of support structure 84, such as lower clamp 62. The sleeve has a continuous inner cylindrical surface 54 and a continuous outer cylindrical surface 56 joined by an annular bottom edge surface 58. The sleeve 52 is connected to support structure 84 by a web 66 which extends radially inward from the upper end of the sleeve. The vertical movement the retainer sleeve 52 is thus decoupled from the vertical movement of the retaining ring 44. Such a decoupling may provide greater versatility, for example, permitting higher compression between the ring 44 and the polishing pad without a corresponding compression engagement between the sleeve 52 and the pad. Unnecessary compression between the sleeve 52 and pad produces wear on the sleeve and increases the frequency with which the sleeve must be replaced. The sleeve 52 may be broken into independently movable segments, similar to the embodiment of FIG. 7 described below. The lower or distal end of the sleeve 52 defines an opening 89 (FIG. 3) to a pocket for receiving the substrate.

During polishing, a net downward force is applied to the substrate so as to slightly compress the polishing pad 20. The force, and thus the compression, are determined so as to achieve the desired polishing rate in view of such factors as the substrate material, pad material and thickness, rotational speeds, and presence/type of polishing slurry used.

Figure 5:
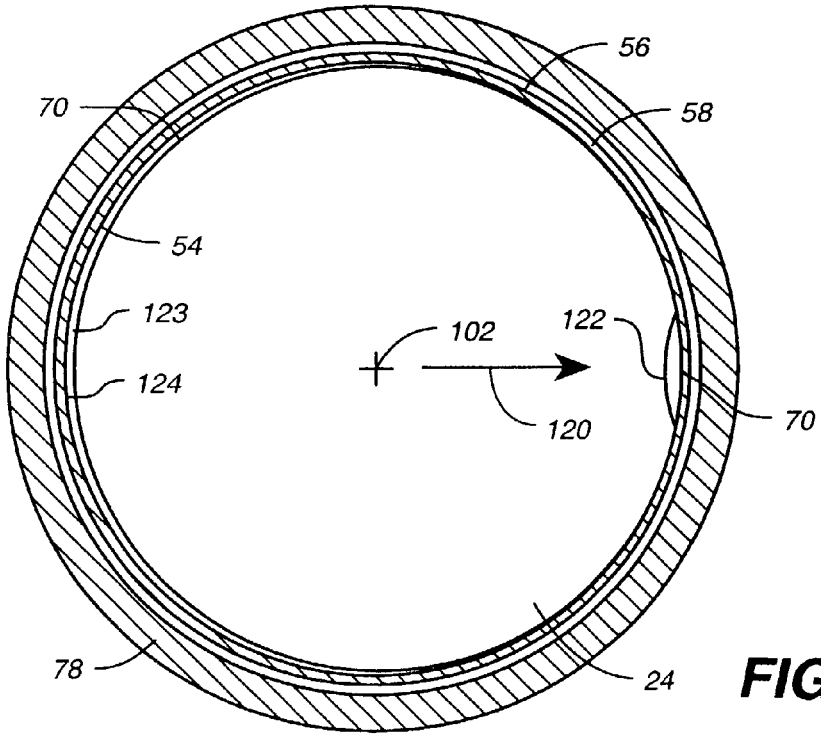
FIG. 5 is a partial schematic bottom view of the retainer of the carrier of FIG. 4.

As shown in FIG. 5, at any given moment, the polishing pad may have a net general direction of motion 120 relative to the substrate and carrier, with friction between the pad and substrate applying a shear force to the substrate so as to bring the substrate edge or perimeter 70 into engagement with the inner cylindrical surface 54 of the sleeve 52. The sleeve's inner surface 54 thus forms a retaining face of the retaining ring 44. In the illustrated embodiment, the engagement is via direct contact at a location 122 that extends along the substrate perimeter 70. An increasing gap 123 between the perimeter 70 of the substrate and retainer sleeve face inner surface 54 reaches a maximum at a location 124 diametrically opposite the location of contact 122. Even this maximum gap, however, is small, typically less than one millimeter.

The sleeve 52 is dimensioned (e.g., the diameters of the inner and outer cylindrical surfaces of the sleeve and the height of the sleeve are appropriately selected) and formed of sufficiently flexible but durable material, such as a plastic to resist the impact of the edge of the substrate, to accommodate to the substrate during polishing as described below. The relaxed diameter (i.e., when not biased by engagement with the substrate during polishing) of the inner surface 54 of the sleeve is slightly greater than the substrate diameter. Due to the flexible and elastic nature of the sleeve 52, engagement between the substrate perimeter 70 and inner cylindrical surface 54 at the contact location 122 will cause the sleeve to flex and compress slightly. Because of this accommodation, instead of having a single circumferential point of contact between the retaining ring 44 and the substrate perimeter 70, the contact location 122 is a continuous circumferential zone of engagement between the inner surface 54 of the sleeve and the substrate perimeter 70. The contact force is thus a pressure distribution across the zone of engagement, whereas in the absence of sleeve 52, there would not be such accommodation and the contact force would be a point force at a single point of contact. The zone of engagement preferably spans at least 10 degrees. Balancing flexibility and wear resistance in the selection of sleeve material, appropriate dimensions may be experimentally determined in view of the necessary lateral force between the ring and substrate. The lateral force is a function of factors including the substrate size and material, polishing pad material, presence and type of polishing slurry, and desired polishing rate. By distributing the contact force along the zone of engagement, distortions in the substrate adjacent to its perimeter are reduced relative to the situation were there is a single discrete point of contact. Thus localized distortions are reduced along with the associated edge effect. In addition, by distributing the force from the substrate across the sleeve, the compression of slurry between the bevel edge of the substrate and the retaining ring is reduced, thereby reducing the agglomeration of slurry and the resulting scratch defects.

During polishing of the substrate, the body of the retaining ring 44, via its bottom face 68, may be pressed against the polishing pad causing the polishing pad to compress as may be desired to allow a more even pressure distribution across the interface between the polishing pad and the lower face of the substrate. Additionally, the retaining ring 44 may provide a degree of backup against lateral movement of the substrate and sleeve relative to the remainder of the carrier head.

In an exemplary implementation, the retaining ring may be formed of polypenylene sulfide (PPS). Configured for use with a 200 mm (7.87 inches) diameter substrate, the diameter of the inner surface of the sleeve may be approximately 7.90 inches, the diameter of the outer surface of the sleeve may be approximately 8.20 inches, the diameter of the inner surface of the retaining ring may be approximately 8.30 inches, and the diameter of the outer surface of the retaining ring may be approximately 9.75 inches. The lower end of the sleeve may be approximately coplanar with the bottom face of the body or slightly recessed therefrom so as to not protrude below the bottom face of the body and, thereby be subject to excessive wear and deformation due to engagement with the polishing pad.

Figure 6:
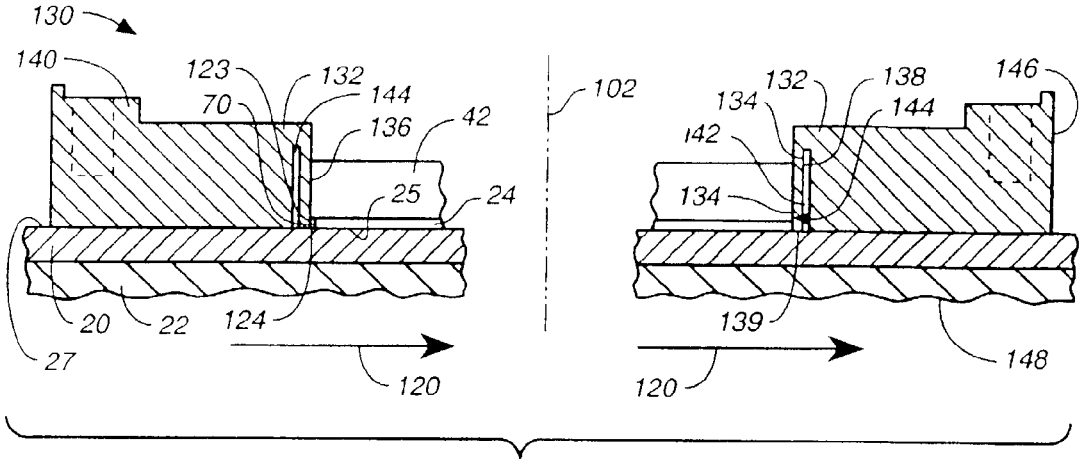
FIG. 6 is a partial schematic cross-sectional view of a retainer system with a sleeve formed as part of a retainer body.

FIG. 6 shows a retaining ring 130 having an upper roof portion 132 from which depends a continuous annular longitudinally-extending sleeve 134. The sleeve has a continuous inner cylindrical surface 136 and a continuous outer cylindrical surface 138 joined by an annular bottom edge surface 139. The retaining ring 130 has a body section 140 outboard of the sleeve 134 (e.g., relatively far from the central axis 102). The body section 140 has an inner cylindrical surface 142 facing and spaced apart from the outer cylindrical surface 138 of the sleeve so that the body is separated from the sleeve by an annular upward directed recess 144. The body section 140 has a cylindrical outer surface 146 connected to the inner surface 142 by a flat horizontal annular bottom face 148. Engagement between the substrate perimeter 70 and inner cylindrical surface 136 at the contact location will cause the sleeve to flex slightly radially outward into the recess 144. The contact force is thus a pressure distribution across the zone of engagement, whereas in the absence of a recess 144, there would not be such accommodation and the contact force would be a point force at a single point of contact.

Figure 7:
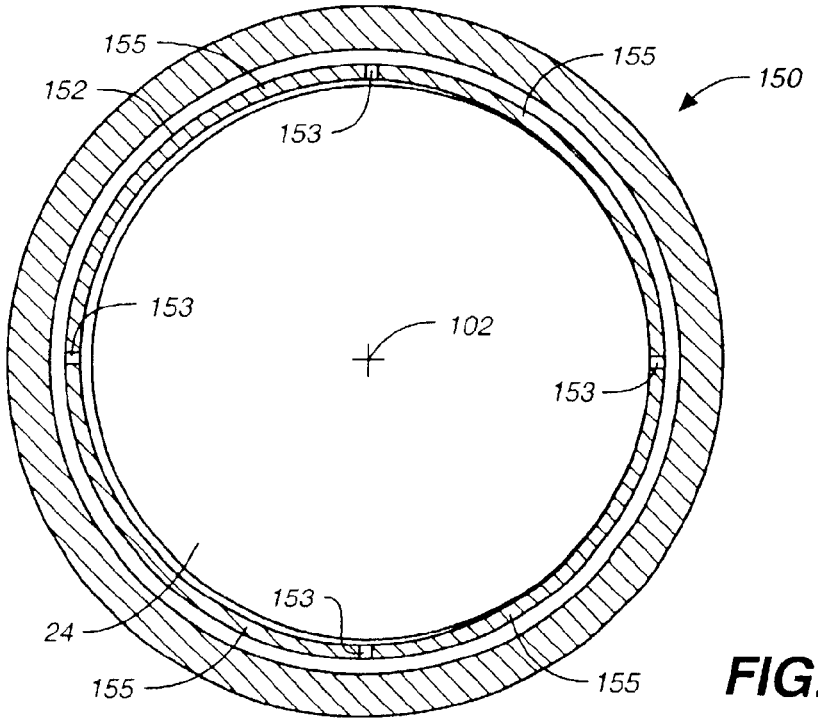
FIG. 7 is a partial schematic bottom view of a retainer system with a segmented sleeve.

FIG. 7 shows a retaining ring 150 having a sleeve 152 which, rather than being continuous, includes a plurality of upward directed (away from the polishing pad) recesses 153 which divide the sleeve into a plurality of radially outwardly flexible spring arms 155. In the illustrated example, four recesses 153 separate the sleeve into four spring arms 155. For a given sleeve height and thickness, the presence of the recesses 153 increases the effective flexibility of the sleeve and increases the accommodation to the substrate 24. This effect arises from the interruptions in the circumferential tension in the sleeve caused by the recesses.

The recesses 153 may comprise cut out regions extending from the interior surface of the sleeve to the exterior surface of the sleeve, or may comprise grooves which extend only partially through the sleeve's thickness.

Figure 8:
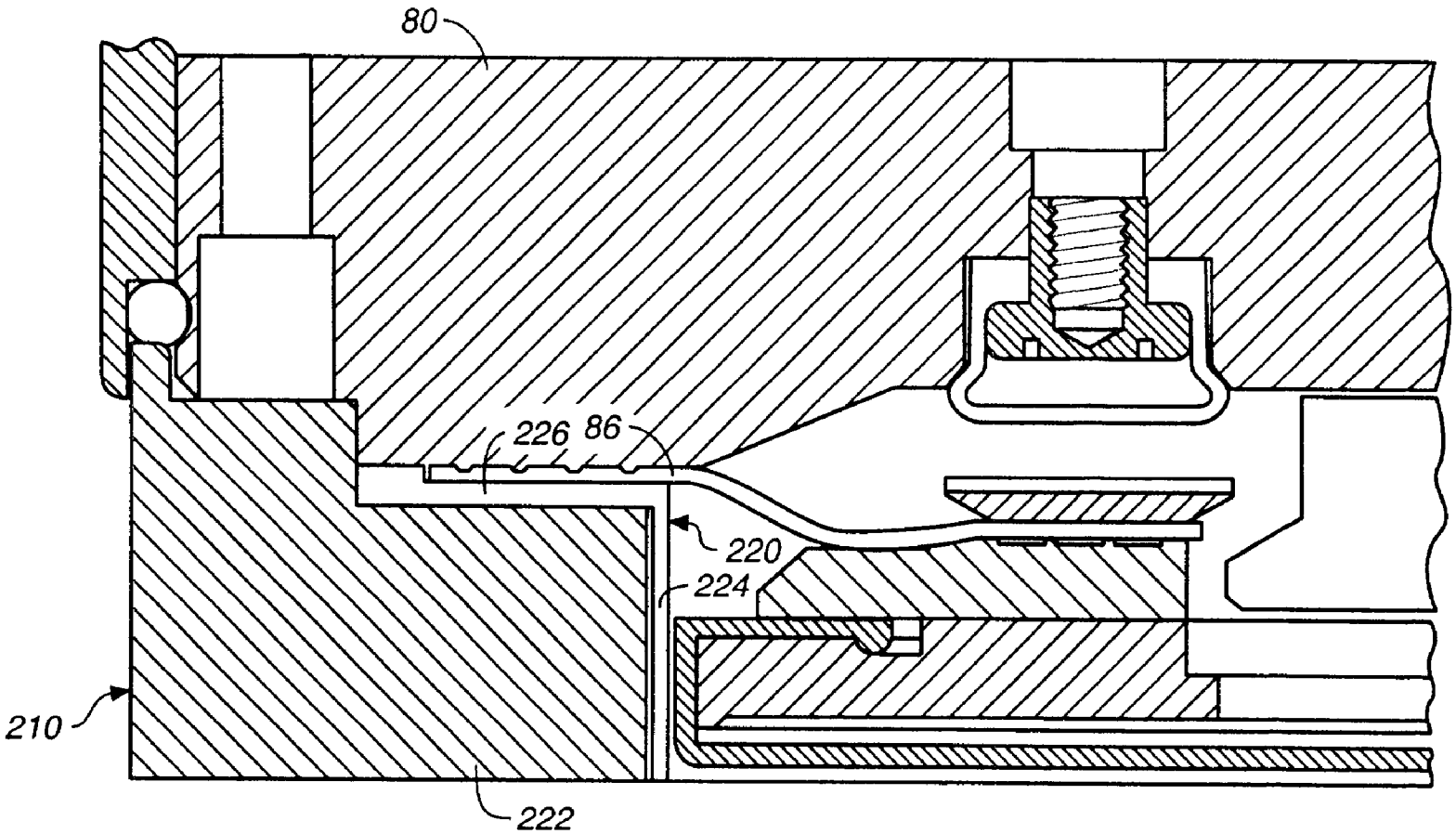
FIG. 8 is a partial schematic cross-sectional view of a retainer system with a sleeve secured to the top of the retainer body.

FIG. 8 shows a retainer system 210 which may be of generally similar overall shape to ring 44 of FIG. 4. Rather than being formed as a unitary ring, the sleeve 220 and body 222 are separately formed. This facilitates using different materials in the sleeve and body, allows different combinations of sleeves and bodies, depending on particular conditions, and allows separate replacement to accommodate different wear rates of the sleeve and body. In particular, the sleeve 220 may be formed of a material that is so flexible that it serves as a bumper to cushion the impact of the substrate but exerts minimal force on the polishing pad. The sleeve 220 includes an annular longitudinally-extending sleeve portion 224 formed integrally with and depending from an annular radially outwardly-extending flange 226. The flange 226 is located immediately below an outer portion of flexure 86. The flange 226 and flexure 86 are clamped between the body 222 and carrier base 80.

Figure 9:
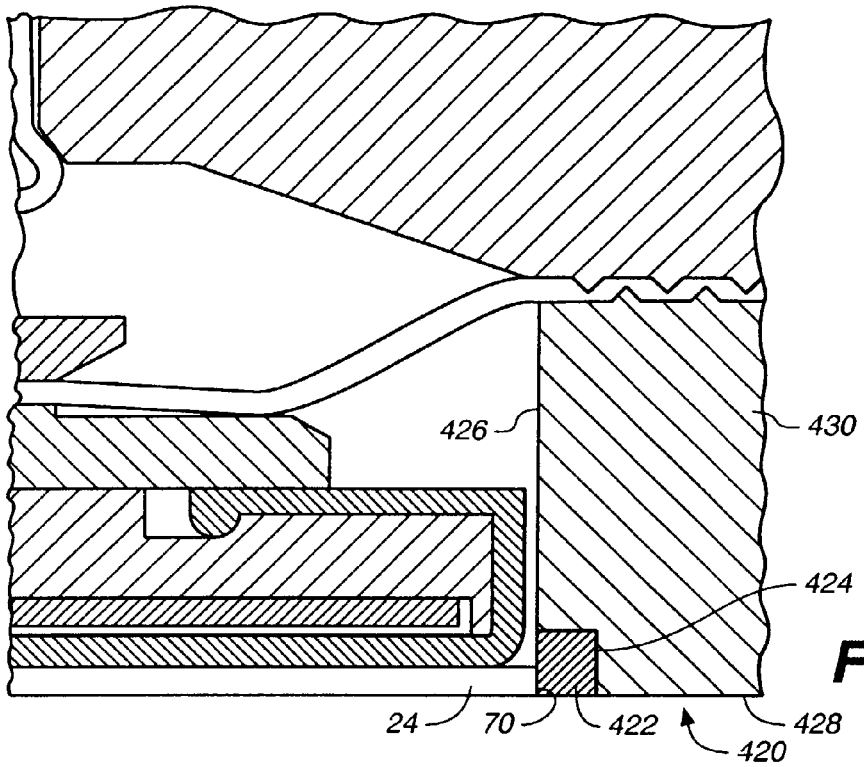
FIG. 9 is a partial schematic cross-sectional view of a retainer system with an elastomeric insert.
Figure 10:
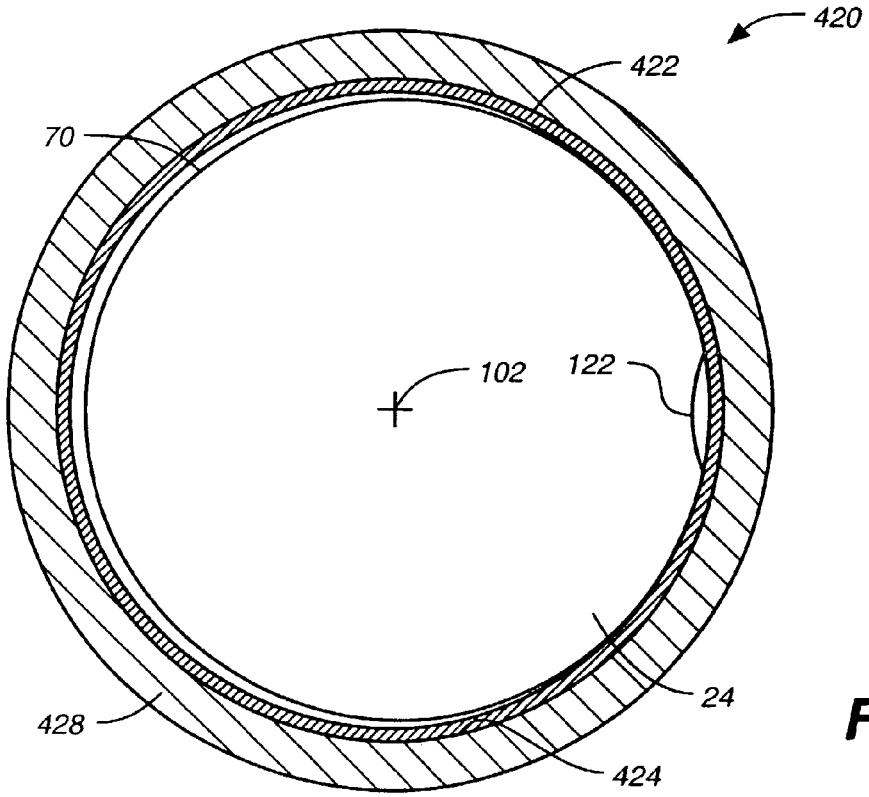
FIG. 10 is a partial schematic bottom view of the retainer system of FIG. 9.

FIGS. 9 and 10 show a retaining ring 420 which carries an annular elastomeric insert 422 in an annular pocket 424 in the inner cylindrical surface 426 of the retaining ring adjacent the bottom face 428 of the retaining ring. The insert 422 is formed of a material which is more compressible than the material forming the ring body 430. In operation, the insert 422 is compressed radially outward by the perimeter 70 of the substrate 24 along a continuous zone of engagement 122 (FIG. 10). The insert 422 is preferably formed of a material which is sufficiently soft (compressible) to accommodate to the substrate and thereby disperse contact forces with the substrate yet durable enough to not significantly increase the frequency at which the carrier head must be serviced. Since the insert 422 is structurally backed by the retaining ring body 430, the insert 422 may be manufactured of a much softer material than the body 430. Such a construction provides greater flexibility in the selection of materials and may provide an enhanced degree of accommodation. For example, with the ring body 430 manufactured of PPS, the insert 422 may be manufactured of an elastomer such as EPDM, urethane or Delrin.

Figure 11:
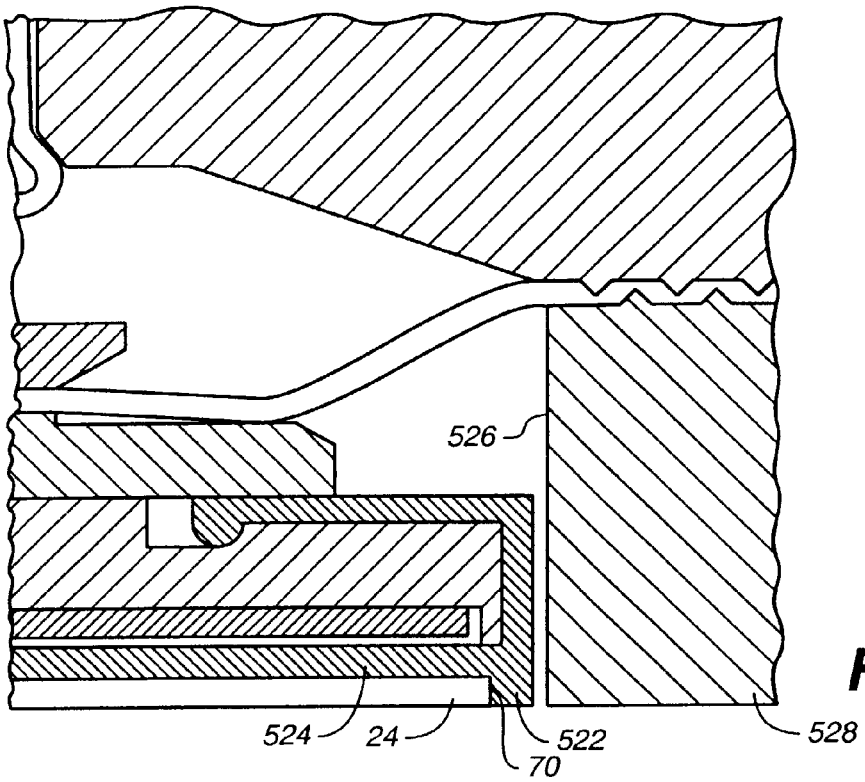
FIG. 11 is a partial schematic cross-sectional view of a retainer system with a lip depending from the flexible membrane.

FIG. 11 shows a retainer formed as an annular lip 522 depending from the substrate backing membrane 524 at the outboard extremity of the membrane. The lip may be compressively sandwiched between the substrate perimeter 70 and the cylindrical inner surface 526 of the retaining ring 528. Preferably the membrane, or at least the lip, is formed of a material soft enough to provide the necessary flexibility and conformability yet hard enough to resist being cut by engagement with the substrate and to resist excessive wear which would increase the frequency with which the head must be serviced. An exemplary material for the membrane is Neoprene.

Figure 12:
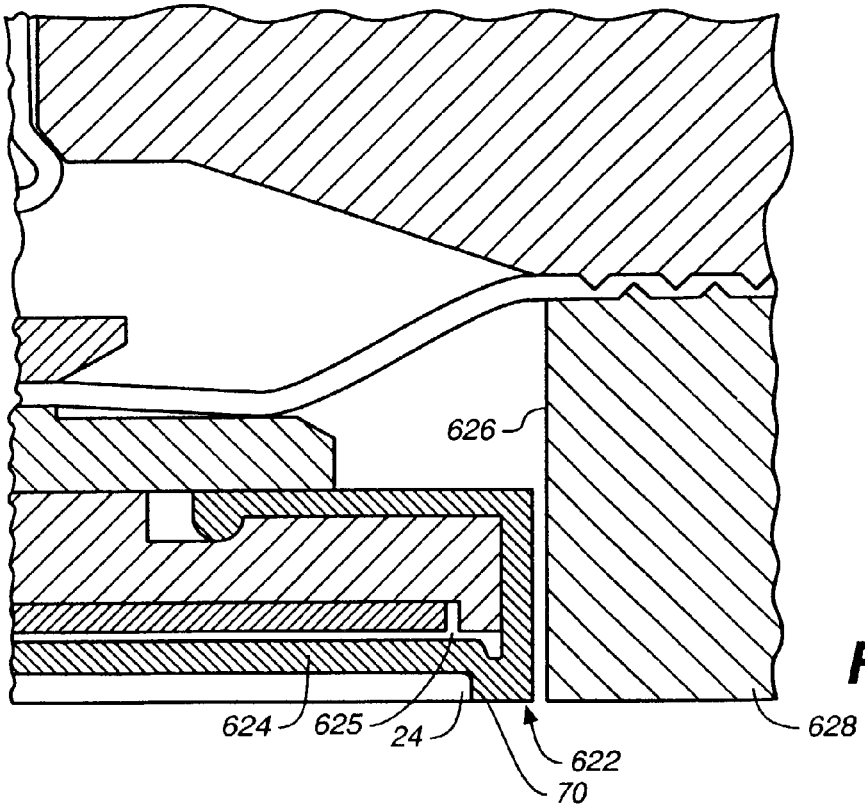
FIG. 12 is a partial schematic cross-sectional view of an alternate retainer system with a lip depending from the flexible membrane.

FIG. 12 shows a lip 622 depending from a backing membrane 624. The lip is formed so that the membrane chamber 625 protrudes into the lip. When the chamber is inflated to press the substrate against the polishing pad, the inflation also laterally expands the lip between the substrate perimeter 70 and the inner surface 626 of the ring 628 so as to compressively engage the substrate perimeter. Such a structure may be used to provide a full 360 degree zone of engagement between the substrate perimeter 70 and the lip 622. Such engagement greatly disperses the contact forces between the substrate and the lip 622, and resists shifting of the substrate within the carrier head.

Figure 14:
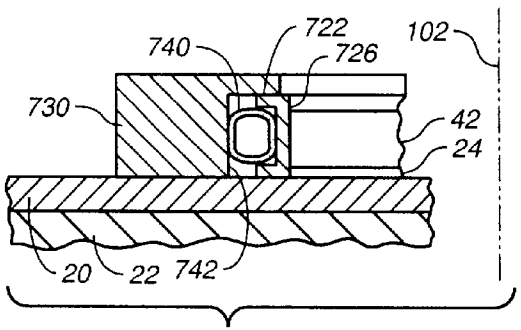
FIGS. 13 and 14 are partial schematic cross-sectional views of a retainer system with a retaining ring having as adjustable diameter in configurations disengaging and engaging a substrate, respectively.
Figure 13:
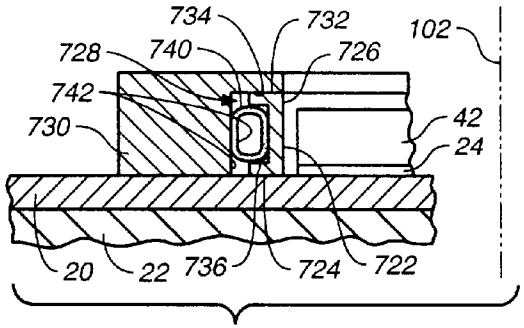
Figure 15:
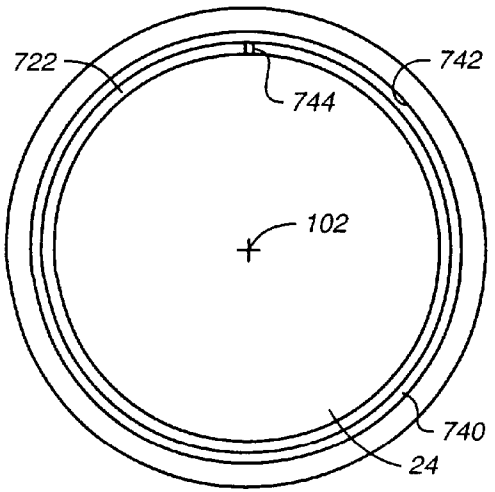
FIG. 15 is a partial schematic bottom view of the retainer system of FIGS. 13 and 14.
Figure 16:
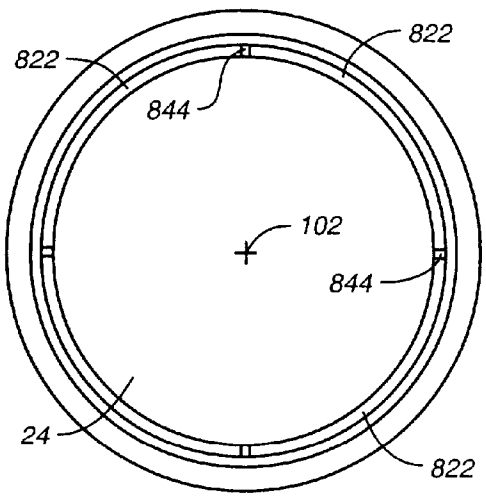
FIG. 16 is a partial schematic bottom view of a retainer system with a retaining ring having a plurality of adjustable segments.

FIGS. 13, 14 and 15 show a retainer formed by a band 722 wrapped substantially around the substrate. The band has a flat bottom face 724 for contacting the upper surface of the polishing pad and a cylindrical inner face 726 for engaging the substrate perimeter. The band 722 rides in an internal bore 728 of a retainer support 730. A flat horizontal upper face 732 of the band engages an annular downward-facing face 734 of the bore. The band is secured vertically within the support but is free to move radially. The outer face of the band has a right circumferentially-extending and outwardly-facing channel 736 in which rides an annular bladder 740. The bladder may engage an inner cylindrical face 742 of the bore 728 as well as engaging the channel 740. As shown in FIGS. 14 and 15, with the bladder 740 sandwiched between the band 722 and the inner face 742 of the bore, inflation of the bladder biases the band radially inward (FIG. 14) so as to compressively engage the substrate perimeter. To facilitate the radial inward moving of the band 722, the band is provided with a cut or gap 144. The gap 744 decreases and increases as the band 722 moves radially inward and outward, respectively. Inflation of the bladder 740 causes a partial closure of the gap. Thus, with the bladder inflated, the inner face 726 of the band 722 engages the substrate perimeter 70 along a continuous circumferential zone of engagement extending around substantially the entire substrate perimeter 70. Optionally, as shown in FIG. 16, the band may be formed as a plurality of a discrete, radially inwardly-biasable segments 822 separated by gaps 844.

Figure 17:
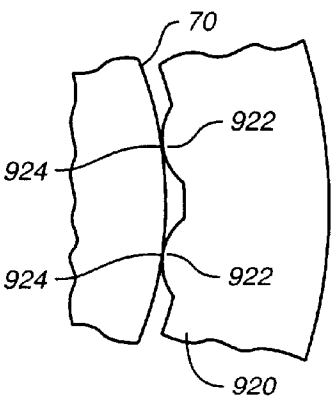
FIG. 17 is a partial cut away bottom view of a retainer system with a plurality of projections extending inwardly from the retaining ring.

FIG. 17 shows a retaining ring 920 having a plurality of radially-inwardly projecting engagement features 922. Depending on materials and construction details, such features may provide plural discrete points of contact 924 or short regions of contact between the ring and the substrate perimeter 70. Such engagement features may either be used in a static retaining ring or in an inwardly biasable retaining ring. In one embodiment of a static ring, a rolling action of the substrate within the ring will cause the substrate to alternate between having one and two points or regions of contact. With an inwardly biasable retaining ring, at least three points or regions of contact will typically be present and the substrate will be held securely within the ring. The engagement features 922 should be formed of a highly durable material to resist the shear and compression forces created when the edge of the substrate abuts the engagement features.

A number of embodiments of the present invention have been described. Nevertheless, it will be understood that various modifications may be made without departing from the spirit and scope of the invention. For example, various features of the invention may be adapted for use in a variety of carrier head constructions. Accordingly, other embodiments are within the scope of the following claims.

What is claimed is:

1. A carrier head for holding a substrate in engagement with a polishing surface, comprising:

a substrate backing member to engage an upper surface of the substrate and apply a downward force to the substrate; and a retainer including a plurality of arcuate sections positioned to annularly surround the substrate backing member, each arcuate section having an inward facing retaining surface, each arcuate section being independently radially movable relative to other sections;

wherein each arcuate section extends from a fixed upper end to a lower end that is laterally movable relative to the fixed upper end;

wherein the retainer includes a unitary annular body, and an upper end of each arcuate section is joined to the unitary annular body; and wherein the unitary annular body includes a bottom surface to contact the polishing pad.

2. The carrier head of claim 1, wherein lower ends of the arcuate sections are approximately coplanar with the bottom surface.

3. The carrier head of claim 1, wherein lower ends of the arcuate sections are recessed from the bottom surface.

* * * * *